United States Patent [19]

Nobutoki et al.

[11] Patent Number: 4,457,732

[45] Date of Patent: Jul. 3, 1984

[54] METHOD OF FABRICATING IMAGE PICKUP TUBES

[75] Inventors: Saburo Nobutoki; Mitsuo Ichikawa; Takeo Sawaguchi, all of Mobara, Japan

[73] Assignee: Hitachi, Ltd., Tokyo, Japan

[21] Appl. No.: 246,601

[22] Filed: Mar. 23, 1981

[51] Int. Cl.[3] ..... H01J 31/26; H01J 9/20

[52] U.S. Cl. ..... 445/35; 313/371

[58] Field of Search ..... 29/25.14, 25.18, 25.17; 313/371; 156/154; 445/35

[56] References Cited

U.S. PATENT DOCUMENTS

| | | | |
|---|---|---|---|
| 2,773,992 | 12/1956 | Ullery | 29/25.17 |
| 3,567,547 | 3/1971 | Mattson | 156/154 |
| 4,004,176 | 1/1977 | Otake et al. | 313/371 |

FOREIGN PATENT DOCUMENTS

| | | | |
|---|---|---|---|
| 56324 | 5/1979 | Japan | 313/371 |

*Primary Examiner*—Kenneth J. Ramsey

*Attorney, Agent, or Firm*—Charles E. Pfund

[57] ABSTRACT

A method for fabrication of an image pickup tube face plate structure comprises adhering a transparent glass sheet material having a thickness of about 40 to 80 microns to a color separation stripe-shaped filter formed on a face plate of the tube, and forming an optically polished surface on a top of the glass sheet while reducing the distance between the top and the stripe filter surface to about 40 microns or less.

4 Claims, 2 Drawing Figures

METHOD OF FABRICATING IMAGE PICKUP TUBES

BACKGROUND OF THE INVENTION

The present invention relates to a method of fabricating image pickup tubes, and particularly to a method of fabricating image pickup tubes with a color separation stripe-shaped filter (will be called a stripe filter hereinafter) formed on the face plate.

The stripe filter falls into the inorganic stripe filter which is formed of striped dichroic thin films and the organic color stripe filter which is formed of striped organic resin films on a glass substrate and colored to have desired hues. Such a stripe filter is arranged on a transparent face plate of the image pickup tube along with a photoelectric conversion element comprised of, for example, a photoconductive film and a transparent conductive film. In this case, it is necessary that the stripe filter be substantially optically contiguous to the surface of the photoelectric conversion element. However, irrespective of the type of the stripe filter, i.e., inorganic or organic, formation of the photoelectric conversion element directly on the stripe filter would impair reliability of the image pickup tube and quality of pictures reproduced, and hence is undesirable. More specifically, in the dichroic stripe filter, filter function portions are raised by about 1 to 3 microns with respect to the remaining portion and if the transparent conductive film for pickup of signals and the photoelectric film are formed directly on the surface of the filter, the photoelectric film will deteriorate along the filter function portions during operation of the image pickup tube and spurious signals will take place. In the case of the organic color filter, it is mainly composed of organic substances including high vapor pressure substances which emit gas when exposed to the vacuum inside the pickup tube, resulting in a malfunction of the tube.

Therefore, the stripe filter of any type needs to be coated with a transparent inorganic material. In conventional dichroic stripe filters, a vapor deposition film of $SiO_2$ or $TiO_2$, or a sputtered film of $SiO_2$ or glass was formed on the filter and polished as desired, and a transparent conductive film was formed on the vapor deposited film.

In the case of the organic color stripe filter, a glass sheet having a substantially finished thickness was adhered to the filter and polished as desired, and a transparent conductive film was formed on the glass sheet. In another method, a thin glass sheet having a substantially finished thickness and provided with a transparent conductive film formed thereon was adhered to the filter.

Conventionally, in the case of an image pickup tube having an approximately 1-inch diameter face plate structure comprised of a face plate, a stripe filter and a photoelectric conversion element, the minimal possible thickness of a glass sheet was preferably about 30 microns or 40 microns at most in order to ensure that the glass sheet can be prepared as having a substantially finished thickness and that the stripe filter can be substantially optically contiguous to the photoelectric conversion element. In order to manufacture flat glass sheets having a thickness of about 30 microns on the industrial scale, for example, a material glass sheet was adhered to a base having a known thickness by means of a temporary binder layer having a known thickness to form a block, the material glass sheet was finished through the steps ranging from rough grinding to final polishing until the block has a desired thickness, and finally the base along with the temporary binder layer was removed from the block to complete a desired thin glass sheet. Typically, while the grinding step uses a diamond tool, a sand abrasive or both in combination, the polishing step uses, for example, fine powder of cerium oxide as an abrasive.

The glass sheet thus manufactured has opposite surfaces of which one is more or less quenched and has compression stress and the other is a mechanically finished surface, and hence has asymmetry in terms of dynamics. And, if opposite surfaces of the glass sheet are finished, a resulting thickness of the glass sheet is so small that mechanical strength of the unitary glass plate is impaired and the glass sheet becomes fragile. Moreover, the above-mentioned method is disadvantageous economically, because the production cost, mainly finishing cost, is raised and the yielding rate is decreased. Accordingly, the impairment of economy is aggravated if one tries to reduce the thickness of the unitary glass sheet to about 30 microns or less. Without reduction to about 30 microns, or 40 microns or less at most, an image of the stripe filter projected by incident light through the pickup lens onto the photoelectric conversion element is blurred, resulting in a reduction in the output color signal amplitude.

SUMMARY OF THE INVENTION

Accordingly, it is an object of the present invention to provide a highly productive, reliable and economical method for fabrication of image pickup tubes which can eliminate the prior art drawbacks and simplify the steps of fabricating the face plate structure.

According to the method of fabricating image pickup tubes based on this invention, a transparent glass sheet having a thickness in the range of from 40 to 80 microns is adhered to the surface of a stripe filter on the transparent face plate, and an optically polished surface is formed on a top of the glass sheet while reducing the distance between the top and the stripe filter surface to about 40 microns or less.

DESCRIPTION OF PREFERRED EMBODIMENT

Figure 1:
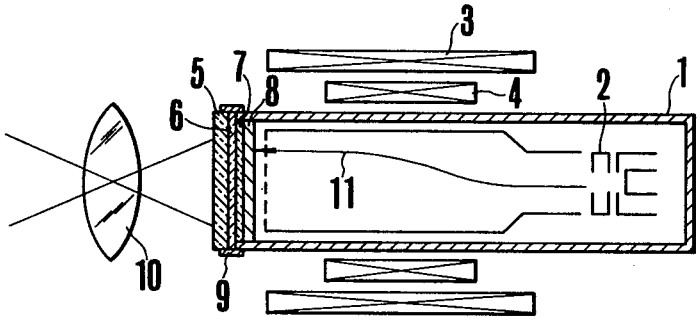
FIG. 1 is a schematic side view, partly sectioned, of an image pickup tube having a face plate structure to which the invention is applied.

The present invention is applicable to fabrication of an image pickup tube face plate structure having, for example, a photoelectric film and a transparent conductive film to constitute a photoelectric conversion element, as disclosed, for example, in U.S. Pat. No. 4,004,176. The overall construction of the image pickup tube in this patent is shown in FIG. 1.

In the figure, reference numeral 2 is an electron gun, numeral 3 a focusing coil, numeral 4 a deflection yoke, numeral 5 a transparent glass window, numeral 6 a stripe-shaped color separation filter, numeral 7 a transparent conductive film, numeral 8 a photoconductive film, numeral 9 an output terminal in electrical connection with the transparent conductive film 7, numeral 10 an optical system, and numeral 11 an electron beam.

The transparent glass window 5, color separation filter 6, transparent conductive film 7 and photoconductive film 8 constitute a face plate structure which is airtightly connected to a tubular envelope 1 of the image pickup tube.

Figure 2:
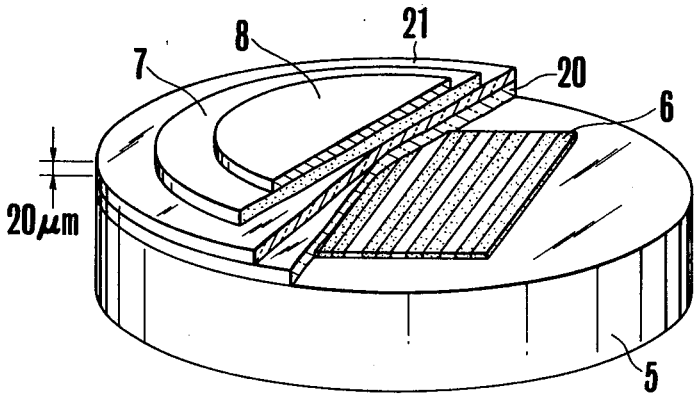
FIG. 2 is a perspective view, partly exploded, of a face plate structure fabricated according to the invention.

Details of a face plate structure embodying the invention are shown in FIG. 2 in which the same parts as those of FIG. 1 are designated by the same reference numerals. The face plate structure includes an adhesive layer 20 and a transparent glass sheet 21 interposed between the transparent conductive film 7 and the filter 6. The transparent glass sheet 21 is prepared through ordinary drawing process, having a thickness of about 50 microns which is a lower limit attained by drawing. Such a glass sheet is available, for example, as MICRO-SHEET GLASS (trade mark). This glass sheet has relatively low accuracy in thickness ranging from 40 to 80 microns even after the both edge portions for drawing have been removed. Therefore, the glass sheet is selectively cut or selected after cutting so as to obtain thin glass sheets 21 within the desired thickness range. Then the thin glass sheet 21 is adhered to the stripe filter layer 6 on the transparent face plate 5 using an adhesive 20. An adhesive of epoxy family resin or epoxy family resin added with silane may preferably be used as adhesive 20. The adhesive 20 is required to be applied as a sufficiently thin layer, to have substantial optical transparency, and to have sufficient hardness and adhesion in the practical temperature range. To meet these requirements, for example, the main epoxy constituent such as EPIKOTE (trade name) 815 or CEMEDINE (trade name) 1565 is admixed with a hardener such as diethylamino propylamine and an additive such as epoxysilane. Using such an adhesive, the adhesive layer can be made as thin as about 5 to 8 microns. After the glass sheet has been adhered to the filter, a top of the glass sheet is finished so that an optically polished surface is formed on the top of the glass sheet while reducing the distance between the top and the stripe filter surface to about 40 microns or less. In the finishing, according to one embodiment of the invention, the top of the glass sheet is subjected to only polishing. It is effective to carry out, in combination, polishing with higher removal rate and lower accuracy, and polishing with lower removal rate and higher accuracy depending on the situation. Since the glass sheet is firmly secured to the face plate glass, according to the above finishing, the thickness of the glass sheet can be made less than 40 microns, possibly a minimum of about 20 to 15 microns, though having dependency on hardness and adhesion of the adhesive.

Polishing described herein uses an abrasive of $CeO_2$ or $Fe_2O_3$ powder which is more fine than an abrasive used for grinding process to be described later and an abrasive disc such as an asphalt pitch surface, or a felt, leather or synthetic leather surface. In consideration of dimensional accuracy of a polished surface, tolerance of polishing scratches and polishing efficiency, the fineness of abrasive powder and the material of abrasive disc may be selected. In polishing, liquid such as water, or water with surfactant or anticorrosive agent is usually used as coolant and circulation medium for abrasive powder.

According to this method, a relatively thick glass sheet material having a thickness of about 50 microns can be handled and adhered to the filter, and consequently, damage of glass sheets which would be caused by careless handling can be prevented. In addition, material of the glass sheet is so inexpensive and the number of finishing steps is reduced, whereby a face plate structure with the stripe filter thereon can be fabricated at low cost. Furthermore, the stripe filter and the photoelectric conversion element can be placed much closer to each other by use of the thin glass sheet when compared with the conventional method, making it possible to obtain a fine stripe filter image on the photoelectric conversion element and consequent a TV image of high resolution. Thus, the amplitude of the color signals can be enhanced, providing a color television image signal with high S/N ratio. Moreover, in prior art method, when a thin glass sheet is adhered to the stripe filter on the transparent face plate, local unevenness of thickness of the applied adhesive is often caused. For example, the adhesive thickness is locally increased by foreign solid materials mixed in the adhesive or becomes irregular when the adhesive is locally deformed owing to the fact that epoxy resin is mixed at irregular mixing ratios and hence becomes hardened irregularly. This causes, in an extreme case, irregular resolution and distortion of reproduced pictures. However, in the method according to this invention, the thickness of the adhesive layer and the thin glass sheet can be made uniform over the face plate, or at least partial unevenness can be avoided.

In the conventional method, the surface of the thin glass sheet needed to be cleaned sufficiently to eliminate dusts before forming the transparent conductive film on the thin glass sheet having a thickness of about 30 microns. However, it is very difficult to eliminate dusts deposited on such thin glass sheets even using ultrasonic washing. When cleaning by vapor washing, the surface of the glass sheet tends to be blotted by vapor since the glass sheet has a small thermal capacitance. Particularly, the inspection standard regulating the degree of dust deposition is more strict for the photoelectric conversion element having a block type structure such as for example SATICON (trade name) than for the ordinary antimony trisulfide family vidicon, imposing severe restrictions on the yielding rate. In this respect, according to the method of this invention, the thin glass sheet is adhered to the stripe filter to form a unitary structure before washing, so that the unitary structure may undergo cleaning by means of any cleaning method including supersonic washing, vapor washing and brush washing, thereby attaining sufficient cleaning of the glass sheet.

In the foregoing embodiment, the top of the microsheet glass was subjected to only polishing. However, when the glass sheet is finished by polishing alone until its thickness is reduced to below 40 microns, the edge of the polished top tends to be rounded. Thus, according to another embodiment of the invention, a thickness reduction process is employed wherein the top of a microsheet is first ground and thereafter polished. On this occasion, polishing with higher removal rate and lower accuracy and polishing with lower removal rate and higher accuracy, in combination, may be carried out as desired.

Rough finishing or grinding referred to herein uses a grinder with an abrasive such as diamond particles or an abrasive disc of casting iron with an abrasive particle of SiC or $A_2O_3$. The grinder process and the abrasive disc process may be combined, if necessary, on several occasions. In grinding, liquid such as water or kerosine is usually used as coolant and circulation medium for abrasive particle.

It should be noted that the foregoing embodiments describe the method wherein a thin glass sheet is adhered to the color stripe filter. However, this invention is not limited to that case, but can also be applied to the dichroic stripe filter.

As described above, in the method of fabricating image pickup tubes in accordance with this invention, the steps of fabricating a face plate structure can be simplified and image pickup tubes can be fabricated through productive, reliable and economical steps.

It should be noted that the above description only mentioned the method of adhering and finishing a thin glass sheet material produced by drawing method. However, a glass sheet material having the same thickness may be obtained by finishing method, and of course the flatness of the thus finished glass sheet material is superior to that of the drawn glass sheet material. It is of great significance that a thin glass sheet material which is thick enough to provide easy handling in adhering is first adhered to the face plate and thereafter the top of the glass sheet material is finished to complete a thin glass sheet of a desired thickness.

What is claimed is:

1. In a method for production of an image pickup tube having a face plate structure wherein on a face plate of the tube, a color separation stripe-shaped filter, an adhesive layer and a transparent glass sheet are laminated in this order, a method of fabricating the face plate structure comprising the steps of:

adhering a transparent drawn glass sheet material having a thickness of about 40 to 80 microns to the color separation stripe-shaped filter on the face plate; and forming an optically polished surface on a top of the adhered drawn glass sheet while reducing the distance between the top and the stripe filter surface to about 40 microns or less.

2. A method for fabrication of the face plate structure according to claim 1 wherein the step for distance reduction comprises a polishing process alone.

3. A method for fabrication of the face plate structure according to claim 1 wherein the step for distance reduction comprises a grinding process and a subsequent polishing process.

4. A method for fabrication of the face plate structure according to claim 2 or 3 wherein said polishing process comprises polishing with higher removal rate and polishing with lower removal rate.

* * * * *